United States Patent [19]

Malashenko et al.

[11] Patent Number: 4,648,943

[45] Date of Patent: Mar. 10, 1987

[54] VIBRATING FORMING SHOE IN A TWIN WIRE FORMER

[75] Inventors: Alexander Malashenko, Quebec; Norman A. Stock, Beaconsfield, both of Canada

[73] Assignee: Valmet-Dominion Inc., Lachine, Canada

[21] Appl. No.: 729,047

[22] Filed: Apr. 30, 1985

[30] Foreign Application Priority Data

May 18, 1984 [CA] Canada ..... 454686

[51] Int. Cl.[4] ..... D21F 1/36; D21F 1/18

[52] U.S. Cl. ..... 162/300; 162/301; 162/352; 162/355

[58] Field of Search ..... 162/355, 356, 301, 303, 162/300, 308, 309, 352, 211

[56] References Cited

U.S. PATENT DOCUMENTS

| | | | |
|---|---|---|---|
| 3,017,930 | 1/1962 | Dunlap | 162/352 |
| 3,810,817 | 5/1974 | Arledter | 162/355 |
| 3,847,731 | 11/1974 | Arledter | 162/211 |
| 4,033,812 | 7/1977 | Rlihinen | 162/273 |
| 4,306,934 | 12/1981 | Seppanen | 162/356 |
| 4,420,370 | 12/1983 | Saad | 162/352 |
| 4,425,188 | 1/1984 | Fujiwara | 162/352 |
| 4,523,978 | 6/1985 | Pullinen | 162/352 |

FOREIGN PATENT DOCUMENTS

| | | | |
|---|---|---|---|
| 930580 | 7/1973 | Canada . | |
| 484111 | 10/1929 | Fed. Rep. of Germany | 162/356 |
| 2152958 | 5/1972 | Fed. Rep. of Germany | 162/356 |
| 47-34643 | 8/1972 | Japan | 162/352 |

*Primary Examiner*—S. Leon Bashore
*Assistant Examiner*—K. M. Hastings
*Attorney, Agent, or Firm*—Raymond A. Eckersley

[57] ABSTRACT

A twin wire paper former incorporating a forming shoe having a curved solid forming surface across which the forming wires pass with one of the wires in direct contact therewith and the other sandwiching the stock from which the paper is to be formed therebetween. The tension in the other wire drives water from the stock contained between the two wires, out through the other wire, and the shoe is vibrated thereby to reduce the friction between the wire contacting the shoe, to reduce wear of the contacting wire and to improve drainage.

8 Claims, 1 Drawing Figure

VIBRATING FORMING SHOE IN A TWIN WIRE FORMER

FIELD OF THE INVENTION

The present invention relates to twin wire formers incorporating forming shoes wherein the forming shoe is vibrated to improve drainage and reduce the wear on the wire contacting the shoe.

BACKGROUND OF THE PRESENT INVENTION

The use of forming shoes having a solid forming surface adapted to contact one of the wires on a twin wire former while squeezing water out through the other wire are well known. One such device is shown in U.S. Pat. No. 4,033,812, issued July 5, 1977 to Graham Riihinen. The particular device shown in this patent is primarily adapted for the formation of tissue paper and incorporates a first open drainage section through a single open stretch bottom wire and then through a twin wire section wherein the wires pass around a solid shoe and water is ejected through the upper wire.

A somewhat similar device is shown in Canadian Pat. No. 930,580 issued July 24, 1973 to McCormack. However, in this device, no significant preforming section is used and substantially all of the drainage takes place upwardly through the top wire with the water drained therefrom being scooped from the top wire and directed into a saveall. This former is primarily concerned with multi-ply papermaking or boardmaking machines.

In both of these devices the wire contacting the forming surface is directed across the forming surface of a shoe which inherently causes wear of the wire.

Obviously the wear on the wire is depended in part on the amount of lubricant that passes between the wire and the surface of the shoe, and thus the wetter the web, the greater the lubrication that is available. In the U.S. Patent, predrainage occurs through the bottom wire before the shoe is reached. Thus, there is a formed layer of stock on the bottom wire which contacts the shoe when the wire traverses the shoe. Obviously, this layer of formed fibres will inhibit flow of water or drainage of water towards the shoe and thereby reduce the amount of lubricant that is available. In the Canadian Patent, very little predrainage takes place and the majority of the formation takes place against the wire remote from this forming surface, thus the problem of lubricating the wire-shoe surface interface is reduced since there is no mat therebetween. However, there is still the significant wear factor encountered and drainage may be improved.

BRIEF DESCRIPTION OF THE PRESENTION

It is an object of the present invention to reduce the wear by reducing the friction between the wire contacting a forming shoe in a twin wire former.

Briefly, the present invention relates to a twin wire former comprising a first wire and a second wire wrapping a forming shoe having a curved solid surface bearing against one of said wires with the tension in the other wire squeezing water from the stock as the wires with wet stock inbetween traverse the shoe, means to resiliently mount said shoe and means to vibrate said shoe at a frequency and amplitude to facilitate movement of said one wire across said shoe thereby reducing the wear of said one wire.

In a preferred arrangement of the present invention, the shoe is pivotted adjacent its leading edge so that the amplitude of the vibration applied by the shoe to the wire increases as the wire traverses along the shoe from the pivot point in the direction of movement of the wires over the shoe.

It has also been found that by imparting vibrations to a shoe, a more random distribution of the fibres forming the mat, thus a better formation may be obtained.

BRIEF DESCRIPTION OF THE DRAWINGS

Further features, objects and advantages will be evident from the following detailed description of preferred embodiment of the present invention taken in conjunction with the accompanying drawings in which.

DESCRIPTION OF THE PREFERRED EMBODIMENT

Figure 1:
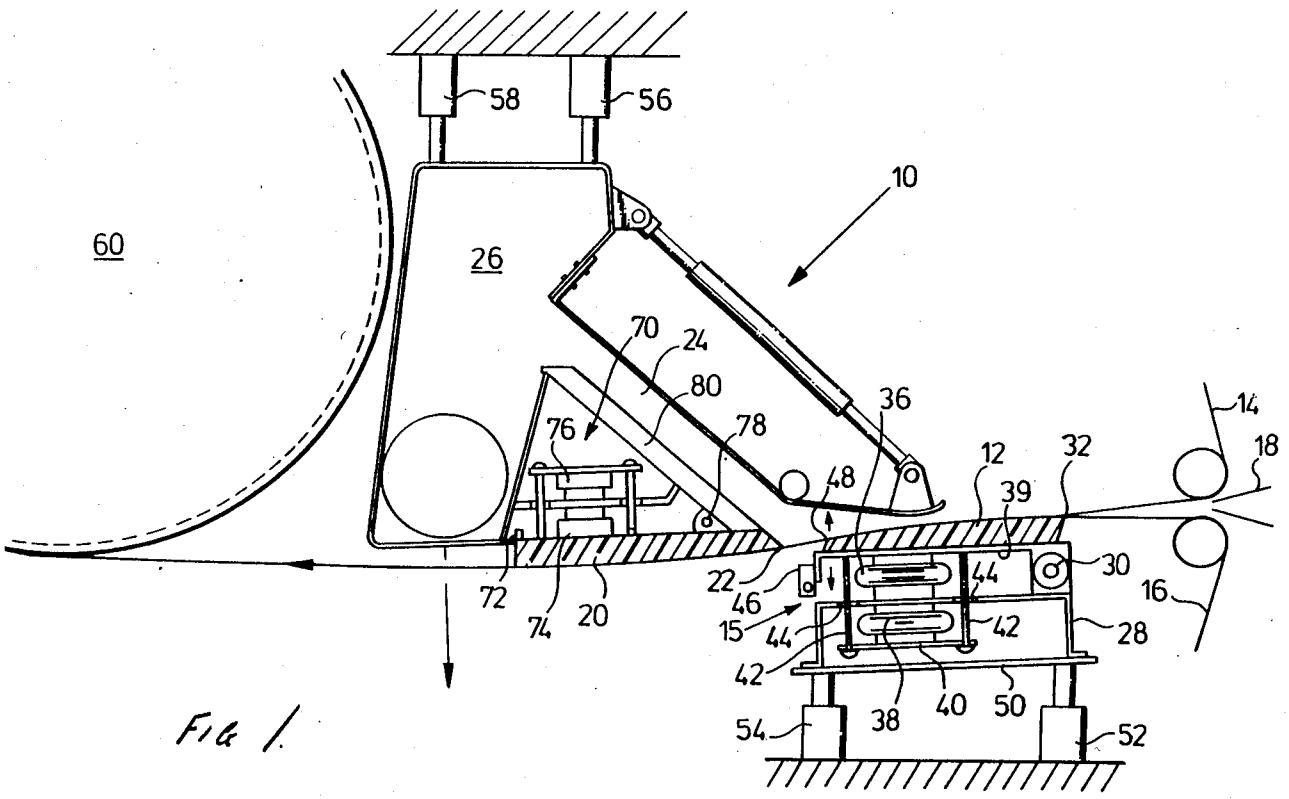
FIG. 1 is a schematic side elevation view of a forming section incorporating the present invention.

As shown in FIG. 1, the forming section generally indicated at 10 is composed of a first forming shoe 12 on which the two forming wires 14 and 16 converge. In the illustrated arrangement, the headbox 18 directs stock directly into the nip formed as the two wires 14 and 16 converge. However, it will be apparent that the wire 16 may be extended to the right and a preforming section be provided wherein drainage occurs first through the wire 16 to form a preformed layer of stock before the twin wire section is reached, for example, as shown in the said U.S. Pat. No. 4,033,812.

In the illustrated arrangement the shoe 12 is followed by a second shoe 20, the leading edge 22 of which forms a doctor edge for deflecting water passing through the upper wire 14 as the wires traverse the shoe 12, into a passage 24 leading to a saveall 26.

It will be noted that the shoe 12 engages the inside of the wire 16 while the tension in the upper wire 14 generates a pressure on the stock contained between these two wires 14 and 16 and forces water upwardly through the wire 14 with this water being deflected by the doctor 22 up passage 24 into the saveall 26.

It will be further noted that little, if any, forming takes place on the wire 16 before the shoe 12 is reached if the headbox is positioned as illustrated. However, if the headbox is moved to the right and a preforming section provided, then a mat will have been formed on the wire 16 before it reaches the shoe 12.

The shoe 12 is mounted on a vibrating mechanism generally indicated at 15. In the illustrated arrangement, the shoe 12 is mounted on a platform formed by a substantially U-shaped support member 28 which in turn mounts a pivot 30 the axis of which is, in the illustrated arrangement, substantially in vertical alignment with the leading tip 32 of the contacting surface of the shoe 12. The shoe itself is mounted on platform 39 which as above indicated is pivotally mounted on pivot 30. This platform 39 is biased from the fixed U-shaped platform 28 via a first air bag or spring means 36 which is interposed between the platform 28 and the platform 39. A second air bag or spring means 38 is interposed between the platform 28 and a plate 40 which is suspended from the platform 39 via rod members 42 which pass freely through suitable holes 44 formed in the plate 28. There will be sufficient number of rods 42 passing through holes 44 to properly support the plate 40 from the platform 44 (only 2 shown).

With this type of arrangement air bag 36 supports the weight of the shoe and wire tension while the air bag 38 may be used to adjust the systems spring constant. Thus by the use of the pair of air bags a very flexible arrangement is provided to adjust for wire tension and spring constant independently.

It will be apparent that the spring members 36 and 38 may take any suitable form and that the air bag is really the preferred arrangement but other resilient or spring means may be used. Furthermore, if adjustability is not necessary for a specific installation then a single spring may be used.

The assembly including the platform 39, air bags 36, 38, plate 42 and rods 44, together with the shoe 12 are vibrated by the vibrator schematically indicated at 46. Any suitable vibrator may be used. In some cases several vibrators may be positioned at spaced locations across the machine and synchronized if the invention is applied to a wide machine.

Vibration of the shoe 12 is imparted to the wire 16 which reduces the friction between the wire 16 of the shoe 12 to thereby reduce the wear on the wire 12.

Surprisingly it has also been found when the shoe is vibrated, not only is wear reduced but also the drainage changes. In a particular installation where a preformed layer was formed on the wire 16 prior to reaching the shoe 12 on an experimental machine, it was found that without vibration, a streak was forming in the resultant sheet, this streak was presumably due to an imbalance on one of the rolls supporting the top wire 14. When the vibrator was activated, this streak tended to disappear and the formation improved. It is not clear what effect vibration had on the actual drainage or on repositioning of the fibres, but the end result was improved formation (more uniform).

It will be noted that in the arrangement illustrated, the shoe pivots on pivot point 30 which is substantially vertically aligned with the leading tip 32 of the contact surface of the shoe. The precise location of this pivot is not critical. However, it must be located so that the tip 32 does not tend to significantly dig into the wire 16 as the vibrations are applied. Furthermore, by providing the pivot point 30 adjacent the front end 32 of the shoe, the amplitude of the vibration felt by the wire progressively increases as the wire moves from the tip 32 to the tail 48 of the shoe 12.

It is not believed that the frequency of vibration and amplitude are critical. However, it will be apparent that the amplitude and frequency must be correlated to reduce the friction between the wire 16 and the shoe 12. It has been found for example, that a frequency of 16,000 cycles per minute using a shoe 12 with a length in the machine direction of about 12 inches, composed of a 4-inch substantially flat section extending from the tip 32 followed by a curved section having a radius of about 100 inches extending from the end of the flat section to the tip 48, produced good results when the amplitude of the vibration at the tip 48 was in the order of 0.003 inches.

The frequency of vibration will be high enough to reduce friction and will normally be in the range of about 1000 to 20,000 cycles per minute preferably between 10,000 to 20,000 since the lower frequencies are less effective.

The amplitude of the vibration measured at the trailing end of the vibrated shoe will be in the range of 1 to 10 thousandths of an inch and will be dependent of the spring constants.

In the illustrated arrangement, the vibrating unit, particularly the support member 28, is in turn supported on a platform 50 which is supported by the front and rear adjustable pillars 52 and 54 (only 2 shown) so that the height of the platform may be physically adjusted and its angle to the horizontal adjusted, thereby to adjust the pressure of the shoe 12 against the wires 16 and 14 and its orientation relative to these wires.

Also as illustrated schematically, the shoe 20 through the saveall 26 to which it is firmly attached is adjustable vertically and in orientation by front and rear adjustable pillars 56 and 58 through which the position of the doctor edge 22 and the orientation of the shoe 20 may be properly adjusted in relation to the shoe 12 and the path of the wires.

In the illustrated arrangement the vibrating shoe has been pivotally mounted. Such a pivotal mounting is not absolutely essential, for example, the front end of the shoe might be supported on a curved spring or resiliently cantilevered so that the amplitude of the vibration applied to the wire 16 increases as one moves from the leading end 32 to the trailing end of 48.

In certain cases it may also be advantageous to simply vibrate the shoe 12 vertically with substantially uniform displacement across the full length. However, the amplitude of vibration may then have to be limited to limit the possibility of the front edge 32 digging into the wire 16 resulting in a significant pressure pulse being generated due to the vibrations.

In the illustrated arrangement, the wires 14 and 16 with the stock trapped therebetween pass from the shoe 20 to suitable conventional dewatering means such as a suitable dewatering roll 60 where further water is driven from the stock since "formation" (as used in the papermaking sense to to describe the distribution of fibres in the finished sheet) will normally be substantially completed when the wires leave the shoe 20.

It will be apparent that if vibrations are to be applied to a shoe, the weight of the shoe or the momentum of the shoe must be relatively small. Thus it is preferred that the shoes to which vibration is to be applied be relatively short in the axial direction, i.e. in the order of 10 to 15 inches measured in the machine direction as too long a shoe mounted as preferred will result in too much movement of the trailing end 48 before sufficient movement is obtained along the length of a shoe.

It will also be noted that by pivotting the shoe adjacent its front end the wires 14 and 16 need not engage the upper surface of the stock on the wire 16 before the shoe since very little vibration will be applied to the upper open surface of the stock before the wire 14 engages same over the shoe 12.

It will be apparent that while only the shoe 12 has been described as mounted for vibration, if desired the shoe 20 may also be so mounted via a vibrating mounting mechanism 70 substantially equivalent to the mechanism 15. The mechanism 70 includes vibrator means 72 and air bags 74 and 76 substantially equivalent to air bags 36 and 38 respectively, and the shoe 20 is pivotally mounted on the saveall 26 via pivot 78 which trails the leading edge 22 slightly (is not vertically aligned as is the pivot 30 with the edge 32). If the slope of the bottom wall 80 of passage 24 requires moving the pivot 78 too, far rearward from tip 22 the pivot may be replaced by a curved spring secured to the under face of the wall 80.

Having described the invention, modifications will be evident to those skilled in the art without departing from the spirit of the invention as defined in the appended claims.

What we claim as new and desire to secure by Letters Patent of the United States is:

1. A twin wire former for forming a paper web from an aqueous stock of papermaking fibers comprising: a first travelling, tensioned, looped forming wire having a substantially horizontal run, a second travelling, tensioned, looped forming wire having a co-operating substantially horizontal run co-operating with said horizontal run of said first wire to form a sandwich of said first and second wires with said stock sandwiched therebetween, a forming shoe within the loop of said first forming wire, said forming shoe having a convex surface bearing against said first forming wire along a portion of said substantially horizontal run, means to mount said forming shoe, said means to mount including means for pressing said shoe against said first forming wire to deform said sandwich around said convex surface and force said first wire into substantial conformity with said convex surface and squeeze water from said stock through said second forming wire, said means for pressing including a first resilient means urging said convex surface against said sandwich and including a second resilient means counteracting said first resilient means, said second resilient means being adjustable to adjust the spring constant of said means for mounting said shoe, and means to vibrate said shoe with an amplitude and frequency such that travel of said first wire over said convex surface of said shoe is facilitated.

2. A twin wire former as defined in claim 1, wherein said means to mount said shoe further includes means for limiting movement of a leading end of said shoe in a manner such that the amplitude of movement of said convex surface progressively increases from said leading end to a trailing end of said shoe.

3. A twin wire former as defined in claim 2, wherein said means to restrict movement of said leading end comprises means pivotably mounting said shoe adjacent said leading end thereof and wherein said shoe pivots around said means pivotably mounting when vibrated by said means to vibrate.

4. A twin wire former as defined in claim 1, wherein said first and said second resilient means each comprises air bag means and wherein said mounting means further comprises a substantially fixed platform, said first air bag means bearing on one side of said platform and the second air bag means bearing against the opposite side of said platform whereby inflation of said first air bag means tends to move said convex surface of said shoe in the opposite direction to the direction it is moved by inflation of said second air bag means.

5. A twin wire former as defined in claim 1, wherein said means to vibrate vibrates said convex surface with a significant component of the amplitude of said vibration being substantially vertical.

6. A twin wire former as defined in claim 2, wherein said means to vibrate vibrates said convex surface with a significant component of the amplitude of said vibration being substantially vertical.

7. A twin wire former as defined in claim 1, wherein said first wire is positioned below said second wire.

8. A twin wire former as defined in claim 2, wherein said first wire is positioned below said second wire.

* * * * *